US005131562A

United States Patent [19]

Brown

[11] Patent Number: 5,131,562

[45] Date of Patent: Jul. 21, 1992

[54] DISPENSER FOR SOFT DRINK LIDS AND THE LIKE

[76] Inventor: Anthony P. Brown, Rte. 1, Cadet, Mo. 63630

[21] Appl. No.: 647,574

[22] Filed: Jan. 28, 1991

[51] Int. Cl.[5] ..... B65H 3/00

[52] U.S. Cl. ..... 221/41; 221/193; 221/268

[58] Field of Search ..... 221/36, 37, 41, 268, 221/276, 311, 40, 261, 231, 193

[56] References Cited

U.S. PATENT DOCUMENTS

| | | | |
|---|---|---|---|
| 1,083,727 | 1/1914 | Claussen . | |
| 1,173,648 | 2/1916 | Cooley . | |
| 1,229,733 | 6/1917 | Errett . | |
| 1,260,432 | 3/1918 | Nias . | |
| 1,272,701 | 7/1918 | Nias . | |
| 1,524,420 | 1/1925 | Bohlman . | |
| 1,761,009 | 6/1930 | De Vries . | |
| 1,964,335 | 6/1934 | Wessman | 312/44 |
| 2,004,520 | 6/1935 | Conti | 312/44 |
| 2,037,751 | 4/1936 | Barbieri | 312/44 |
| 2,037,752 | 4/1936 | Bares | 312/44 |
| 2,139,433 | 12/1938 | Bares | 312/35 |
| 2,141,684 | 12/1938 | Diemer | 312/70 |
| 2,235,855 | 3/1941 | Turnbull | 312/44 |
| 3,161,320 | 12/1964 | Swanson | 221/255 |
| 3,272,384 | 9/1966 | Edwards | 221/1 |
| 3,283,955 | 11/1966 | Crabtree | 221/251 |
| 3,477,592 | 11/1969 | Kuhlman | 214/8.5 |
| 3,702,103 | 11/1972 | Price et al. | 113/114 |
| 3,795,346 | 3/1974 | Roberts et al. | 221/223 |
| 3,864,898 | 2/1975 | West | 53/328 |
| 3,904,077 | 9/1975 | Luginbuhl | 221/175 |
| 3,998,238 | 12/1976 | Nigro | 133/5 A |
| 4,319,441 | 3/1982 | Credle | 53/131 |
| 4,643,334 | 2/1987 | Steele | 221/63 |
| 4,742,937 | 5/1988 | Blom | 221/223 |
| 4,792,057 | 12/1988 | Mizer et al. | 221/187 |
| 4,949,526 | 8/1990 | Brogna et al. | 53/306 |
| 5,000,345 | 3/1991 | Brogna et al. | 221/5 |

*Primary Examiner*—H. Grant Skaggs
*Attorney, Agent, or Firm*—Grace J. Fishel

[57] ABSTRACT

A dispenser for dispensing lids for soft drinks or the like from a stack held in an upright container having a discharge opening. An abutment shoulder is attached to the inside of the upright container near its discharge opening. The lowermost lid in the stack is held by the abutment shoulder. In starting position, a prong projects through the container above the lowermost lid. The prong is manually moved by a handle on the outside of the container to a position below the abutment shoulder. As the prong moves below the abutment shoulder, it flexes the lowermost lid and releases it from the abutment shoulder. The lid drops through the discharge opening as the prong is returned to starting position by a spring.

9 Claims, 3 Drawing Sheets

DISPENSER FOR SOFT DRINK LIDS AND THE LIKE

The present invention relates to a dispenser for dispensing lids for soft drinks or the like from a stack.

BACKGROUND OF THE INVENTION

There are many kinds of dispensers for disposable cups which are commonly used in fast food restaurants and convenience markets. Disposable lids for soft drinks and the like, however, are usually kept in open-storage trays. When needed, a clerk dips his hand into the tray and takes out a lid. This is sometimes difficult to accomplish with one hand because the lids tend to stick together. In addition, the trays are normally accessible only by store personnel to minimize the possibility of bacterial transmission or other contamination. Obviously, the present way of dispensing disposable lids makes it more difficult to render fast service and entirely defeats the objectives of self-service.

SUMMARY OF THE INVENTION

A main feature of the invention is to provide a dispenser for use in serially dispensing lids from a stack of nested concavo-convex lids wherein the lids are generally flat with a raised rim which is U-shaped in cross-section with an outwardly flared lip. The dispenser includes an upright container means with an inner wall for holding the stack of lids in a substantially coaxial inverted stack adjacent an open discharge end of the container means. The stack includes a lowermost lid and a next-to-lowermost lid. The dispenser further includes an abutment shoulder attached to the inner wall of the container means on its open discharge end for supporting the lowermost lid in the stack by its outwardly flared lip and for preventing the stack of lids from escaping from the container means. A movable dispensing means is attached to the container means and has an operative portion extending between the lowermost lid and the next-to-lowermost lid. The operative portion flexes the lowermost lid when the operative portion is manually moved to a position below the abutment shoulder causing the lowermost lid to be released from the abutment shoulder and to fall through the open discharge end while the next-to-lowermost lid takes the place of the lowermost lid in the stack.

An important object of the present invention is to provide a dispenser which serially dispenses drink lids and which can be operated with one hand.

Another object of the present invention is to provide a dispenser for drink lids for use by the public which keeps the lids safe from contamination until required for use.

Other objects and features of the invention will be in part apparent and in part pointed out hereinafter.

The invention accordingly comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings and in which.

DETAILED DESCRIPTION OF THE INVENTION

Figure 1:
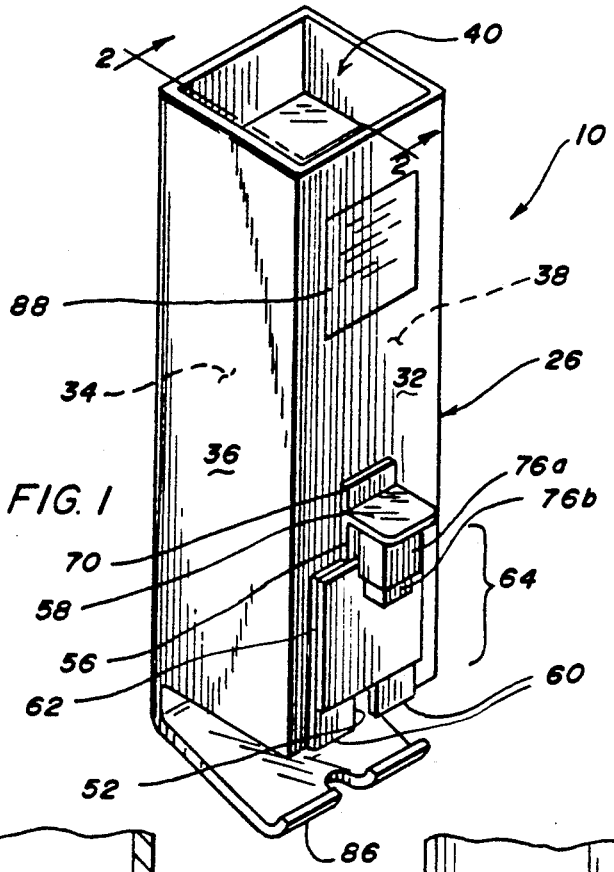
FIG. 1 is a perspective view of a dispenser for dispensing lids for soft drinks and the like in accordance with the present invention.

Referring to the drawings, a dispenser 10 is shown serially dispensing disposable lids 12. The lowermost lid is designated 14 and the next-to-lowermost lid is identified with reference character 16.

Figure 8:
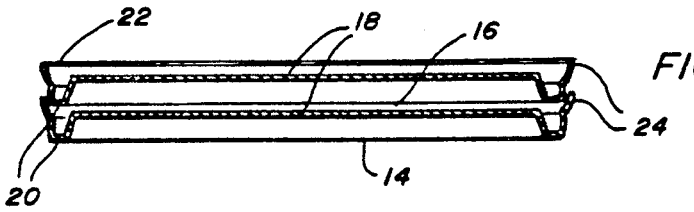
FIG. 8 is an enlarged sectional side view of two lids in an inverted stack.
Figure 10:
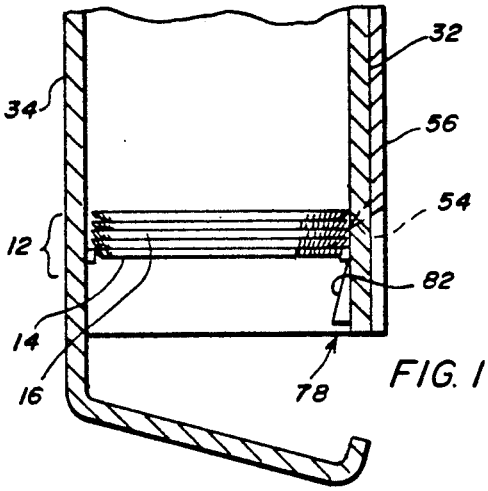
FIG. 10 is a sectional side view like FIG. 2 but of the dispenser shown in FIG. 9.
Figure 11:
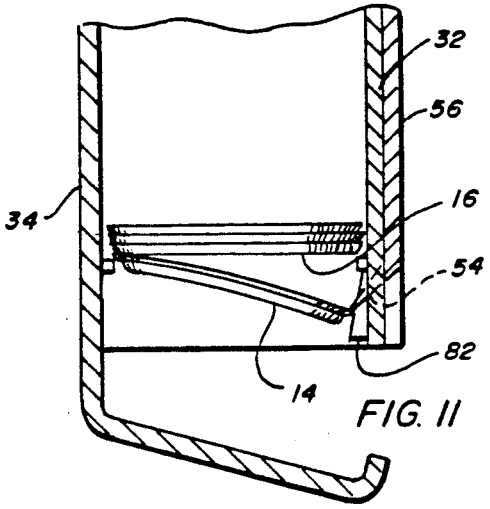
FIG. 11 is like FIG. 10 but wherein the dispensing means has dislodged the lowermost lid from one side of the abutment means; and, FIG. 12 is like FIG. 11 but wherein the lowermost lid has been discharged into the tray below the open discharge end and the movable dispensing means is shown returned to starting position.
Figure 12:
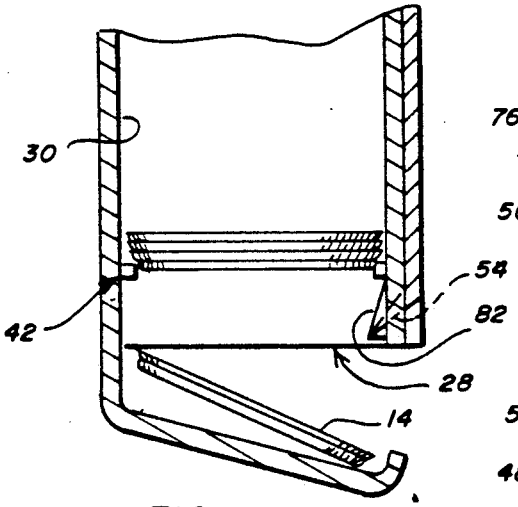
Figure 9:
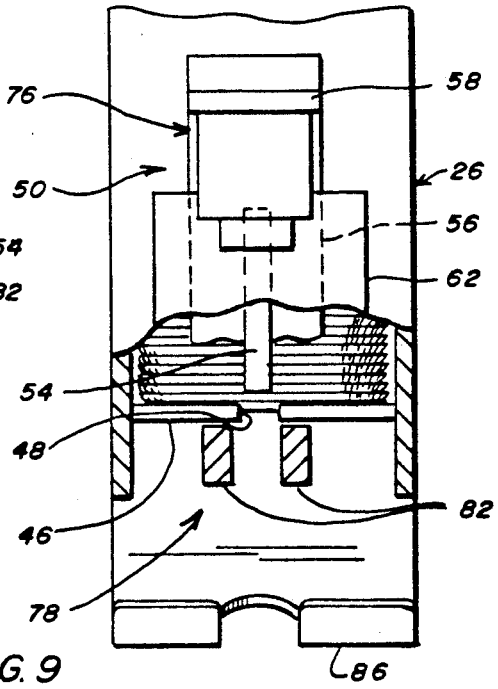
FIG. 9 is a front view like FIG. 4 but of a second dispenser in accordance with the present invention with the lower front side broken away to show the movable dispensing means and the separation wedges.

Lids 12 are usually made of plastic and are flexible and self-supporting. Lids 12 are concavo-convex with a generally flat portion 18 and a raised rim 20 such that lids 12 nest in a stack. As shown in FIG. 8, rim 20 is U-shaped in cross-section with a slightly inclined outwardly flared lip 22. Lip 22 is commonly made with a burr 24 (i.e., a defect) forming a narrow flange running partially or completely around the edge of the lip.

Dispenser 10 includes an upright container means 26 with an open discharge end 28 and an inner wall 30 for holding a plurality of lids 12 inverted in a substantially coaxial stack adjacent the open discharge end. Dispenser 10 may have any suitable cross-sectional configuration as long as its inner wall 30 is coextensive with lids 12 (although specifically shown as having a square cross-section with inner wall 30 formed by front, rear and right and left sides 32, 34, 36 and 38, respectively). As shown in the drawings, lids 12 are stacked in container means 26 through an open filling end 40 or, for example, through a vertical loading slot (not shown), or by opening container means 26 along a vertical dividing line (not shown) and in a number of other ways which will occur to those skilled in the art.

An abutment shoulder 42 is attached to inner wall 30 for supporting lowermost lid 14 by its outwardly flared lip 22 at the open discharge end of container means 26 and preventing the stack of lids from escaping. As shown in FIGS. 1-7, abutment shoulder 42 is formed by a pair of opposing arcuate segments 44 attached to inner wall 30 and, more particularly, attached to right and left sides 36 and 38. In the embodiment shown in FIGS. 9-12, on the other hand, abutment shoulder 42 comprises an annular ring 46 attached to inner wall 30 and having a split 48 in registry with a slot 52 described below.

A movable dispensing means 50 is attached to container means 26. An operative portion 54 of dispensing means 50 is positioned above lowermost lid 14 and separates the lowermost lid from the other lids in the stack. Operative portion 54 also flexes lowermost lid 14 as operative portion 54 is manually moved to a position below abutment shoulder 42.

As shown in the drawings, operative portion 54 of movable dispensing means 50 comprises a prong attached to a slide 56. Prong 54 (i.e., the operative portion) projects through slot 52 in inner wall 30 (specifically shown in front side 32 and running upwardly from open discharge end 28). A handle 58 is attached to slide 56 opposite prong 54. A pair of mounting blocks 60 are attached to opposite sides of slot 52 and are bridged with a plate 62. Mounting blocks 60 and plate 62 form a frame 64 within which slide 56 can be manually reciprocated with handle 58.

A resilient biasing means 66 is attached to movable dispensing means 50 for deforming rim 20 of new lowermost lid 14 to allow operative portion 54 to return to its starting position above abutment shoulder 42 when pressure on movable dispensing means 50 (e.g., handle 58) is released. A stop means 68 (with upper and lower operative elements 70 and 72 as more particularly described below) is provided on container means 26 for confining movement of movable dispensing means 50 between upper and lower limits. At the upper limit, operative portion 54 is stopped above lowermost lid 14 and in the lower position, operative portion 54 is stopped below abutment shoulder 42.

Figure 2:
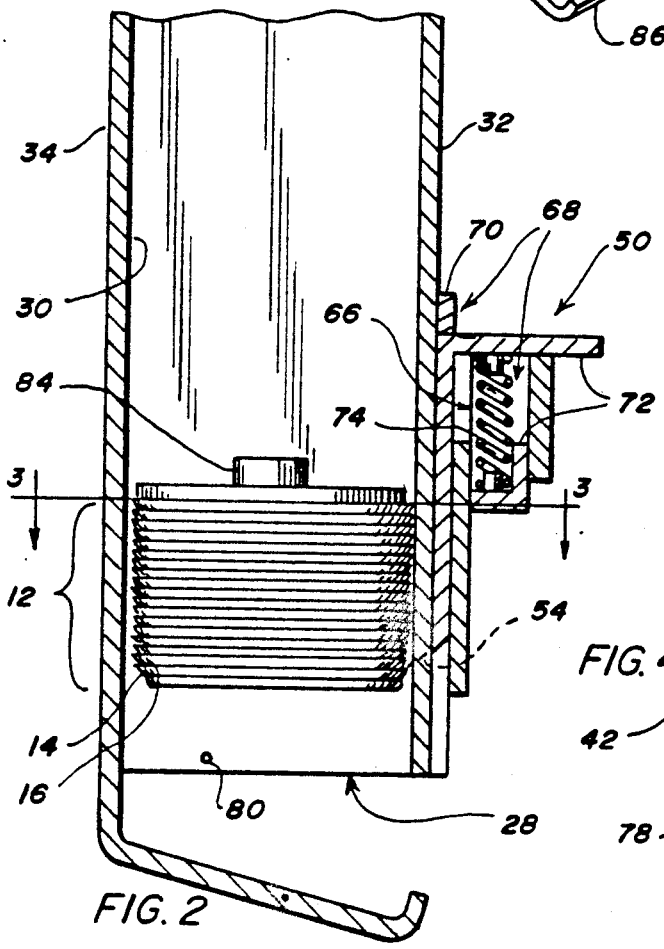
FIG. 2 is a sectional view taken along line 2—2 in FIG. 1.
Figure 4:
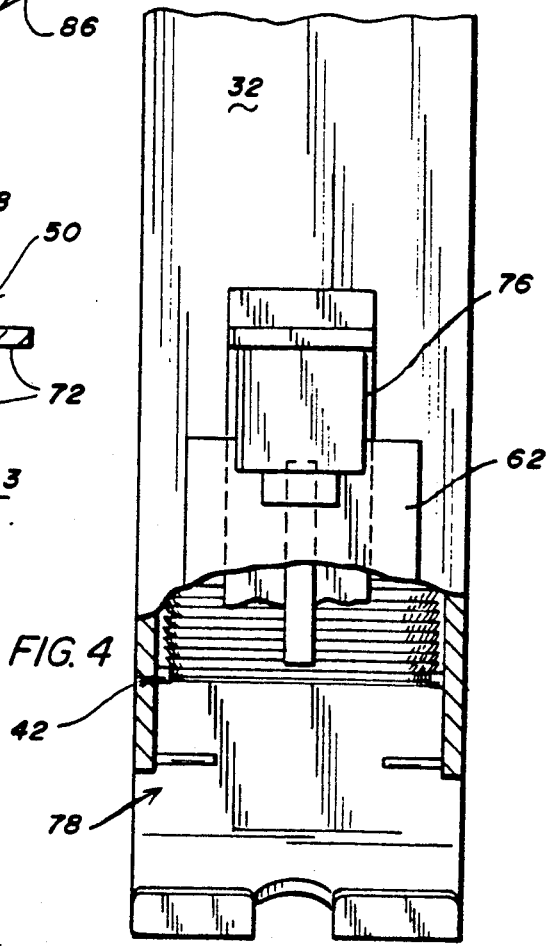
FIG. 4 is a front view of the dispenser shown in FIG. 1 with the lower front side broken away to show the movable dispensing means and the separation bars.
Figure 3:
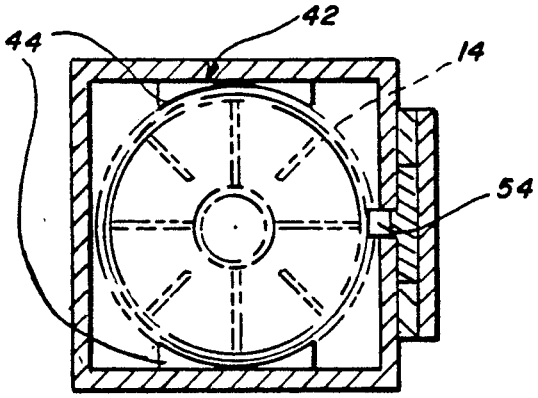
FIG. 3 is a sectional view taken along line 3—3 in FIG. 2.

As shown in the drawings, resilient biasing means 66 comprises a compression spring 74, opposite ends of which are attached to movable dispensing means 50 and to container means 26. Compression spring 74 is preferably housed within an encasement 76 for reasons of safety and sanitation. Encasement 76 has mating sections **76*a* and 76*b* which slide one inside the other until stopped by the other. As best seen in FIG. 2, one end of compression spring 74 is attached to upper section 76*a* while the other end of compression spring 74 is attached to lower section 76*b***.

The upper operative element 70 of stop means 68 limits the upward travel of slide 56. As illustrated, upper operative element 70 is a block attached to container means 26 above slide 56. The function of lower operative element 72, on the other hand, is provided by lower encasement section **76*b* which is fixedly attached to container means 26 (specifically attached to plate 62) and prevents further downward movement of slide 56 when upper and lower sections 76*a* and 76*b*** are fully enmeshed.

Separation means 78 are provided below abutment shoulder 42 for supporting lowermost lid 14 when it is partially separated from the abutment shoulder. As shown in FIGS. 1-7, separation means 78 comprise a pair of opposing rods 80 attached to inner wall 30 (specifically attached to right and left sides 36 and 38), whereas in FIGS. 9-12 separation means 78 comprise a wedge 82 attached adjacent slot 52 (specifically illustrated as a pair of wedges on opposite sides of slot 52).

A weight 84 can be applied to the top of the stack of lids 12 and a dispensing tray 86 can be supplied below open discharge end 28. In the embodiment shown in FIG. 1-7, a wedge 82 is positioned above abutment shoulder 42 on inner wall 30 generally opposite to movable dispensing means 50 and an advertising message 88 is provided on front side 32.

In use, dispenser 10 can be hung from a wall or sat upon a counter or special rack. A plurality of dispensers 10, preferably arranged side by side can be provided to dispense different sized lids. Inserts (not shown) can be provided to change the cross-sectional configuration of container means 26 so that a given dispenser 10 can be used to dispense different sized lids. Other modifications (for example to the stroke of movable dispensing means 50) may also be necessary but will be readily apparent to those skilled in the art in view of the foregoing detailed description of the invention.

Container means 26 is filled with a stack of inverted lids 12. This may be accomplished in a number of ways as indicated above (i.e., through open filling end 40, vertical loading slot and so forth). Lids 12 may be stacked loose or they may be deposited in container means 26 in a sleeve. The sleeve may be withdrawn or it may be left in place if it has an open bottom and a aperture in registry with slot 52.

The weight of the stack forces lowermost lid 14 against abutment shoulder 42. This action is enhanced if pressure is applied to the stack with weight 84 or otherwise applied with a spring (not shown) or the like.

As shown in FIGS. 2-4 and FIGS. 9-10, in starting position prong 54 projects through slot 52 above lowermost lid 14. When a lid is required, the user manually depresses handle 58 which causes slide 56 to move downwardly. Prong 54 is carried on slide 56 below abutment shoulder 42 until further movement of slide 56 is stopped by the enmeshment of upper and lower encasement sections **76*a* and 76*b***.

Figure 5:
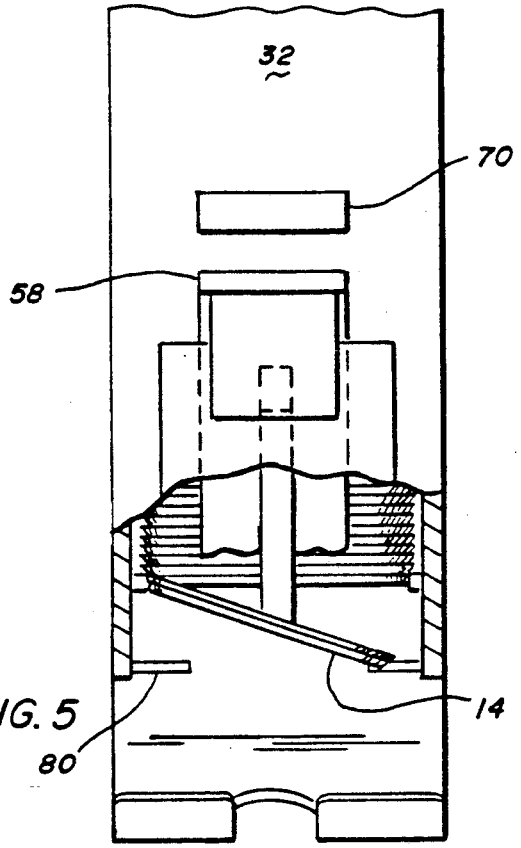
FIG. 5 is like FIG. 4 but wherein the movable dispensing means has dislodged one side of the lowermost lid which is shown resting on the separation bars.
Figure 6:
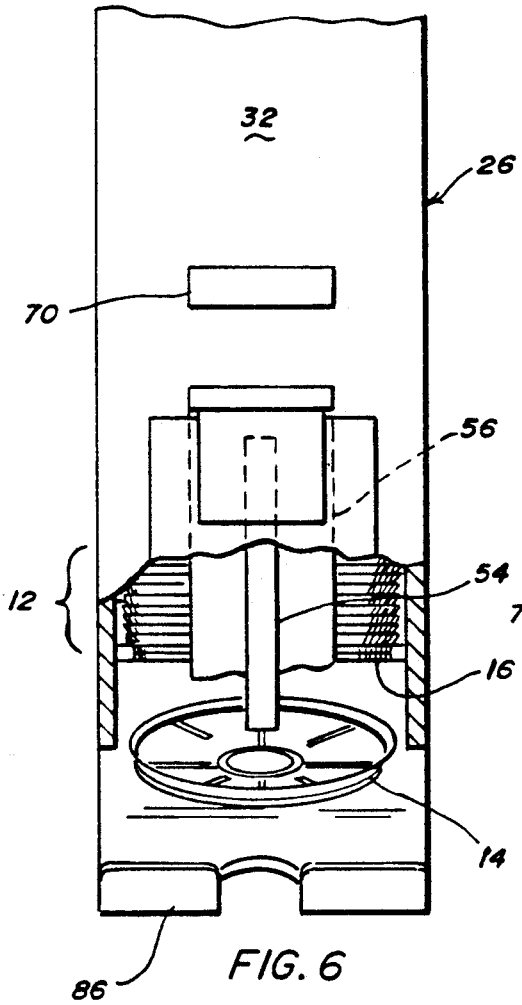
FIG. 6 is like FIG. 4 but wherein the dispensing means has entirely dislodged the lowermost lid from the abutment shoulder.

As prong 54 moves below abutment shoulder 42, lowermost lid 14 is flexed and released from the abutment shoulder. Sometimes lowermost lid 14 is initially released only on one side of abutment shoulder 42, an event which is particularly likely to occur when lids 12 have burrs 24. In the embodiment shown in FIGS. 1-7 when this occurs as shown in FIG. 5, the released side is held by separation means 78 (shown as rods 80). As shown in FIG. 6, the partially released lowermost lid 14 is supported by separation means 78 until prong 54 can finish releasing it from abutment shoulder 42.

Figure 7:
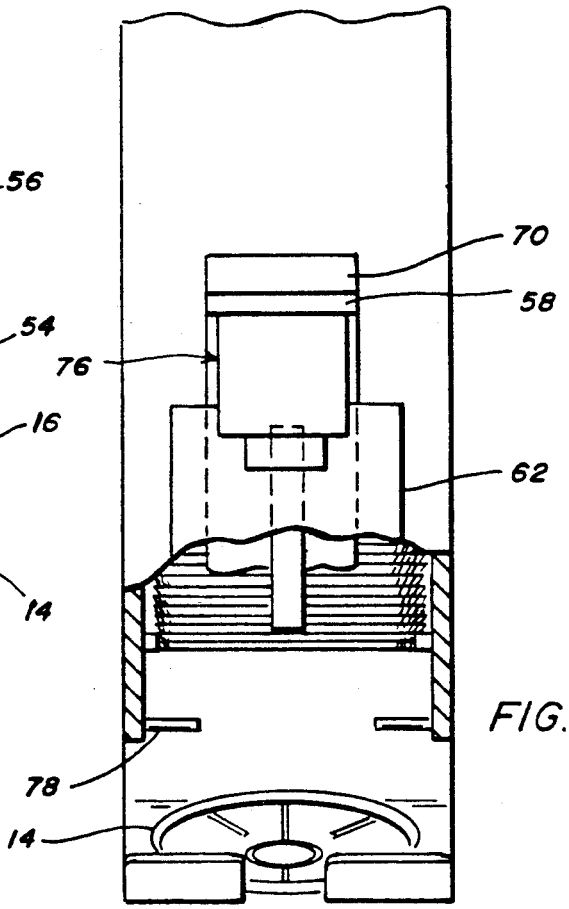
FIG. 7 is like FIG. 4 but wherein the lowermost lid has been discharged into the tray below the open discharge end and the movable dispensing means is shown returned to starting position.

After lowermost lid 14 is released from abutment shoulder 42 as shown in FIG. 7, lowermost lid 14 falls into dispensing tray 86 and next-to-lowermost lid 16 takes its place on abutment shoulder 42. Handle 58 is then released and prong 54 is moved back to starting position by resilient biasing means 66. As prong 54 is moved back into starting position, it bends rim 20 of new lowermost lid 14 slightly. To prevent new lowermost lid 14 from moving away from abutment shoulder 42 as prong 54 is moved back into starting position, serrations (not shown) may be provided in inner wall 30 to resist upward movement of the lid.

Operation of the embodiment shown in FIGS. 9-12 is similar to that for the dispenser shown in FIGS. 1-7 except that wedges 82 take the place of rods 80. Wedges 82 like rods 80 hold lowermost lid 14 until prong 54 completely releases it from abutment shoulder 42.

In view of the above, it will be seen that the several objects of the invention are achieved and other advantageous results attained. As various changes could be made in the above constructions without departing from the scope of the invention, it is intended that all matter contained in the above description or shown in the accompanying drawings hall be interpreted as illustrative and not in a limiting sense.

What is claimed:

1. A dispenser for use in serially dispensing lids from a stack of nested concavo-convex lids, said lids being generally flat with a raised rim with an outwardly flared lip, said stack of lids having a lowermost lid and a next-to-lowermost lid, said dispenser comprising:

an upright container means with an inner wall for holding the stack of lids in a substantially coaxial inverted stack adjacent an open discharge end of the container means;

an abutment shoulder attached to the inner wall of the container means on its open discharge end for supporting the lowermost lid in the stack by its outwardly flared lip and preventing the stack of lids from escaping from the container means; and, a movable slide attached to the container means and mounted for reciprocation between first and second vertically spaced positions along a path generally parallel to the axis of the stack, said slide having a prong and a handle mounted on opposite sides, said prong extending outwardly from one side of the slide and positioned to extend between the lowermost lid and next-to-lowermost lid in the stack when in the first position for separating the lowermost lid from the next-to-lowermost lid and for flexing the lowermost lid when the slide is manually moved by the handle to the second position where the prong is below the abutment shoulder whereby the lowermost lid is released from the abutment shoulder and falls through the open discharge end while the next-to-lowermost lid takes its place in the stack.

2. The dispenser of claim 1 further comprising a resilient biasing means for moving the movable slide and allowing the prong to return to the first position above the abutment shoulder between the lowermost lid and the next-to-lowermost lid.

3. The dispenser of claim 2 further comprising a stop means for limiting travel of the movable slide between the first and second positions, said movable slide being stopped at the first position such that the prong is between the lowermost lid and the next-to-lowermost lid and said slide being stopped at the second position such that the prong is below the abutment shoulder.

4. The dispenser of claim 3 further comprising separation means below the abutment shoulder for supporting the lowermost lid when it is partially separated from the abutment shoulder by the prong until the prong can finish releasing the lowermost lid from the abutment shoulder.

5. The dispenser of claim 1 wherein the slide is reciprocated in a frame attached to the upright container means.

6. The dispenser of claim 5 further comprising a spring with first and second ends, said first end attached to the movable slide and said second end attached to the frame, said spring returning the slide to its starting position when the handle is released.

7. The dispenser of claim 6 further comprising an upper and lower stop for stopping movement of the slide in the frame between an upper limit where the prong is between the lowermost lid and the next-to-lowermost lid and a lower limit where the prong is below the abutment shoulder.

8. The dispenser of claim 7 further comprising a wedge attached to the inner wall below the abutment shoulder for supporting the lowermost lid when it is partially separated from the abutment shoulder by the prong until the prong can finish releasing the lowermost lid from the abutment shoulder.

9. A dispenser for use in serially dispensing lids from a stack of nested concavo-convex lids, said lids being generally flat with a raised rim with an outwardly flared lip, said stack of lids having a lowermost lid and a next-to-lowermost lid, said dispenser comprising:

an upright container means with an inner wall for holding the stack of lids in a substantially coaxial inverted stack adjacent an open discharge end of the container means;

an abutment shoulder attached to the inner wall of the container means on its open discharge end for supporting the lowermost lid in the stack by its outwardly flared lip and preventing the stack of lids from escaping from the container means; and, a movable slide attached to the container means and mounted for reciprocation between first and second vertically spaced positions along a path generally parallel to the axis of the stack, said slide having a prong and a handle mounted on opposite sides, said prong extending outwardly from one side of the slide and positioned to extending between the lowermost lid and next-to-lowermost lid in the stack when in the first position for separating the lowermost lid from the next-to-lowermost lid and for flexing the lowermost lid when the slide is manually moved by the handle to the second position where the prong is below the abutment shoulder whereby the lowermost lid is released from the abutment shoulder and falls through the open discharge end while the next-to-lowermost lid takes its place in the stack, said dispenser further comprising a pair of wedges attached vertically to the inner wall on opposite sides of the prong and pointed upwards towards the abutment shoulder for supporting the lowermost lid when it is partially separated from the abutment shoulder by the prong until the prong can finish releasing the lowermost lid from the abutment shoulder.

* * * * *